US006777033B2

(12) United States Patent
Kloeckner et al.

(10) Patent No.: US 6,777,033 B2
(45) Date of Patent: Aug. 17, 2004

(54) PROCESS FOR REFINISHING SUBSTRATES

(75) Inventors: Harald Kloeckner, Lindlar (DE); Guenter Berschel, Cologne (DE); Andrew Duda, Gladbeck (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 31 days.

(21) Appl. No.: 10/100,104

(22) Filed: Mar. 18, 2002

(65) Prior Publication Data

US 2003/0175432 A1 Sep. 18, 2003

(51) Int. Cl.[7] ..... B05D 3/02; B05D 1/36; B05D 1/02

(52) U.S. Cl. ..... 427/407.1; 427/140; 427/385.5; 427/421

(58) Field of Search ..... 427/407.1, 421, 427/384, 385.5, 140

(56) References Cited

U.S. PATENT DOCUMENTS

| | | | | |
|---|---|---|---|---|
| 3,979,535 A | | 9/1976 | Govindan | |
| 4,837,271 A | * | 6/1989 | Brindopke | 525/330.3 |
| 5,069,956 A | | 12/1991 | Murata et al. | |
| 5,683,745 A | | 11/1997 | Liedtke et al. | |
| 5,820,986 A | | 10/1998 | Töpfel et al. | |
| 5,871,809 A | | 2/1999 | Liedtke et al. | |
| 6,332,291 B1 | * | 12/2001 | Flosbach et al. | 522/91 |

FOREIGN PATENT DOCUMENTS

| | | | | |
|---|---|---|---|---|
| EP | 0 531 058 A2 | | 3/1993 | |
| GB | 2 159 437 | | 12/1985 | |
| JP | 63093380 A | * | 4/1988 | B05D/7/14 |
| WO | 00 68325 | | 11/2000 | |

OTHER PUBLICATIONS

EPO Communication dated Jul. 25, 2003.

* cited by examiner

*Primary Examiner*—Elena Tsoy
(74) *Attorney, Agent, or Firm*—Steven C. Benjamin

(57) ABSTRACT

The present invention relates to a spot repair finish process for refinishing substrates, in particular vehicle bodies or parts thereof, wherein a very good quality finish is produced with virtually no differences, such as in color shade or overspray margins and edge marks, visually perceptible between the old finish and the repair finish. The spot repair process of the present invention works especially well with pigmented coatings of critical color shade, in particular with specific light color shades.

11 Claims, No Drawings

PROCESS FOR REFINISHING SUBSTRATES

FIELD OF THE INVENTION

This invention relates to a process for refinishing substrates, in particular vehicle bodies, by means of spot repair.

DESCRIPTION OF RELATED ART

In vehicle refinishing, often only parts of a vehicle body or small damaged areas of a vehicle component need coating. When refinishing, it is vital to coat the vehicle part or damaged area so that there is no differences in color shade, special effect or other visually perceptible features relative to the surrounding old finish.

Various spot repair methods have already been developed in order to obtain very good quality, visually unblemished refinish coatings. WO 95/14540 (U.S. Pat. No. 5,871,809) accordingly describes a refinishing process that is intended to avoid clouding, especially in special effect, water-borne base coats. The water-borne base coat is applied onto the existing coating in two spray passes, preferably without interim flashing-off between the spray passes, in each case until a boundary of the old finish is reached. This operation is repeated until the entire part to be coated has been provided with the base coat.

EP 773 840 (U.S. Pat. No. 5,820,986) describes another process for avoiding color shade differences in refinishing, in which ESTA-applied (electrostatically supported application); special-effect base coats exhibiting specific Theological behaviour are refinished by HVLP (high volume low pressure) application of the special-effect base coat.

WO 95/07148 (U.S. Pat. No. 5,683,745) describes a refinishing process in which, during application of the base coat onto the regions of the old finish adjacent to the damaged area, the spray gun is inclined diagonally towards the damaged area and a normal or only moderately reduced spray gun inlet pressure is used.

It has not, however, hitherto proved possible to completely and satisfactorily solve all problems with regard to visual matching between the refinish and the old finish. For example, quality is still occasionally impaired by edge marks. Especially in the case of light-colored pigmented coatings, edge marks may occur in the transitional zone between the old finish and the repair finish. Clearly visible over spray margins are obtained that are generally perceptible as peripheral zones that are lighter, darker and/or differ in color shade. In some light beige or light yellow color shades, for example, a yellow/red edge mark is observed.

There accordingly still is a requirement for a novel refinishing process by means of spot repairing that overcomes the disadvantages of the prior art.

SUMMARY OF THE INVENTION

The present invention provides a process for refinishing substrates, in particular vehicle bodies or parts thereof, by means of spot repair finish. In this process, even in the case of pigmented coatings of critical color shades, in particular with specific light color shades, very good quality finishes are obtained and visually perceptible differences of any kind are largely avoided, such as differences in color shade, over spray margins and edge marks, between the old finish and the repair finish.

The invention relates to a process for refinishing substrates, in particular vehicle bodies or parts thereof, by means of spot repair, wherein at least one color- and/or special effect-imparting coating layer of a color- and/or special effect-imparting coating composition is applied onto a damaged area of a substrate and wherein the process comprises the following steps:

A) preparing a mixture 1 by mixing the color- and/or special effect-imparting coating composition with a diluent V containing organic solvents in a ratio by volume of color- and/or effect-imparting coating composition:diluent V of 2.0:1 to 1:1.3, preferably of 1.5:1 to 1:1.2, particularly preferably of 1.2:1 to 1:1.1, wherein the diluent V comprises:
   a) 35–65 wt. % of at least one (cyclo)aliphatic ketone having 3–8, preferably 5–6, C atoms in the (cyclo) alkyl residue and
   b) 65–35 wt. % of at least one glycol ether ester, preferably a glycol ether acetate, having 3–8, preferably 4–6, C atoms in the glycol ether residue, whereby the sum of weight percentages of a) and b) is 100 wt-%, B) applying the mixture 1 produced in step A) onto the damaged area in a layer thickness such that an opaque coating layer is obtained, C) preparing a mixture 2 by mixing the color- and/or special effect-imparting coating composition with the diluent V in a ratio by volume of color- and/or effect-imparting coating composition:diluent V of 1:1 to 1:3, preferably of 1:1.5 to 1:2.5, D) applying the mixture 2 produced in step C) onto the damaged area at reduced spray gun inlet pressure and E) curing the color- and/or special effect-imparting coating layer applied in this manner.

DETAILED DESCRIPTION OF THE EMBODIMENTS

In the process according to the invention, a precoated damaged area of a substrate is coated with a color- and/or special-effect imparting base coat and a clear coat or alternatively with a color- and/or effect-imparting one-layer topcoat. It has surprisingly been found that the process according to the invention gives rise to refinish coatings having perfect visual quality that exhibit no differences in color shade relative to the surrounding old finish and no edge marks in the transition between the old finish and repair finish.

The process according to the invention is carried out by initially preparing in step A) a mixture 1 of the color- and/or special effect-imparting coating composition and the diluent V. The color- and/or effect-imparting coating composition comprises the pigmented coatings known to the person skilled in the art and conventional for vehicle refinishing, such as, for example, one-component or two-component base coats or one-component or two-component one-layer top coats. The pigmented coatings substantially comprise solvent-based coatings.

Binder systems usable in the color- and/or effect-imparting coating compositions are, for example, those based on water-dilutable or solvent-dilutable polyurethane, acrylated polyurethane, polyacrylate, polyester, acrylated polyester and/or alkyd resins. The binder systems may be physically drying and/or chemically cross-linking by means of addition polymerization, polycondensation and/or polyaddition reactions. Chemically cross-linkable binder systems contain appropriate cross-linkable functional groups. Suitable functional groups are, for example, hydroxyl groups, isocyanate groups, acetoacetyl groups, unsaturated groups, for example (meth)acryloyl groups, epoxy groups and amino groups. Cross-linking agents having appropriate complementarily reactive functional groups may be present for cross-linking purposes. Preferred chemically cross-linkable binder systems are those comprising binders containing hydroxyl groups and polyisocyanate cross-linking agents.

The coating compositions may contain further resins, for example cellulose esters and/or melamine resins.

The above list of binder systems is given merely by way of example. The binders may also be further modified and combined with each other at will. There are no particular restrictions as to the binders that may be used. It is possible to use any binders that are known to the person skilled in the art and, in particular, are conventional in vehicle refinishing for formulating color- and/or effect-imparting coating compositions.

The color- and/or effect-imparting coating compositions contain color-imparting pigments. Color-imparting pigments comprise any organic or inorganic pigments conventional in coatings. Examples of inorganic or organic color-imparting pigments are titanium dioxide, micronized titanium dioxide, iron oxide pigments, carbon black, azo pigments, phthalocyanine pigments, quinacridone or perylene or pyrrolopyrrole pigments. Soluble dyes and/or transparent pigments may optionally also be present.

The coating compositions may also contain special-effect pigments. Examples of special-effect pigments are metal pigments, for example made from aluminium or copper, interference pigments, such as metal oxide-coated metal pigments, for example titanium dioxide-coated, iron oxide-coated or mixed oxide-coated aluminium, coated micas, such as micas coated with titanium dioxide and/or with other metal oxides, for example $Fe_2O_3$ and/or $Cr_2O_3$, lamellar iron oxide and graphite pigments.

The coating compositions may furthermore contain organic solvents and/or conventional coating additives.

The organic solvents comprise conventional solvents used by the coatings technology. These may originate from production of the binders or are added separately. Examples of suitable solvents are mono- or polyhydric alcohols, for example propanol, butanol, hexanol; glycol ethers or esters, for example diethylene glycol dialkyl ethers, dipropylene glycol dialkyl ethers, in each case comprising C1 to C6 alkyl, ethoxypropanol, ethylene glycol monobutyl ether; glycols, for example ethylene glycol, propylene glycol, N-methylpyrrolidone and ketones, for example methyl ethyl ketone, acetone, cyclohexanone; aromatic or aliphatic hydrocarbons, for example toluene, xylene or linear or branched aliphatic C6–C12 hydrocarbons.

Examples of usable conventional coatings additives are levelling agents, rheological agents, such as highly disperse silica or polymeric urea compounds, thickeners, such as polyacrylate thickeners containing carboxyl groups or polyurethane-based associative thickeners, microgels, defoaming agents, wetting agents, anticratering agents, coupling agents and curing accelerators. The additives are used in conventional quantities known to the person skilled in the art.

The color- and/or effect-imparting coating compositions exhibit a solids content of for example 18–40 wt. %.

In step A) of the process according to the invention, the color- and/or effect-imparting coating composition is mixed in a specific mixing ratio with the diluent V containing organic solvents. Diluent V substantially contains components a) and b). Component a) of the diluent V comprises at least one (cyclo)aliphatic ketone having 3–8, preferably 5–6, C atoms in the (cyclo)alkyl residue. Examples of usable ketones are methyl isobutyl ketone, methyl isoamyl ketone, methyl n-amyl ketone, ethyl amyl ketone, diisobutyl ketone, cyctohexanone and methoxyhexanone. Component a) preferably exhibits a boiling temperature of 140–165° C. Cyclohexanone is particularly preferably used as component a). Component b) of the diluent V comprises at least one glycol ether ester, in particular at least one glycol ether acetate having 3–8, preferably 4–6, C atoms in the glycol ether residue. Examples of usable glycol ether acetates are methoxypropyl acetate, ethoxypropyl acetate and ethylene glycol monoethyl ether acetate. Component b) preferably exhibits a boiling temperature of 138–165° C. Methoxypropyl acetate is particularly preferably used as component b). The diluent contains 35–65 wt. %, preferably 45–55 wt. % component a) and 65–35 wt. %, preferably 55–45 wt. % component b). The diluent V may optionally contain relatively small quantities, preferably less than 10 wt. %, of further organic solvents.

The color- and/or effect-imparting coating composition is mixed in step A) with the diluent V in a ratio by volume of color- and/or effect-imparting coating composition:diluent V of 2.0:1 to 1:1.3, preferably of 1.5:1 to 1:1.2, particularly preferably of 1.2:1 to 1:1.1, to obtain the mixture 1.

In step B) of the process according to the invention, the mixture 1 of the color- and/or effect-imparting coating composition and the diluent V is applied onto the damaged area by spraying.

Prior to application, the damaged area may, if necessary, be prepared in the conventional manner. The damaged area may be prepared, for example, by cleaning, sanding and optional applying a putty, primer and/or primer surfacer material. The putty, primer and/or primer surfacer material may comprise conventional coating compositions as are used in vehicle refinishing by the person skilled in the art for filling, priming or surfacing. The materials used may be solvent-based or water-based. Application may, however, also be performed on a still intact, cured old or original finish. In this case, the old or original finish is conventionally cleaned and sanded.

Once the damaged area has been appropriately prepared, the mixture 1 of color- and/or effect-imparting coating composition and diluent V is applied onto the damaged area in a layer thickness such that a substantially opaque coating layer is obtained. An opaque layer is obtained if the applied pigmented coating composition is capable of hiding the color or color differences of the substrate (c.f. also definition of hiding power to DIN 55945).

Spray application may here be carried out at normal or reduced spray gun inlet pressure. The actual value for normal or reduced spray gun inlet pressure depends upon the application system or type of spray gun being used. A distinction is substantially drawn between three different types. When using an HVLP gun (HVLP=high volume, low pressure), normal spray gun inlet pressure is approx. 2.0–2.5 bar and reduced spray gun inlet pressure approx. 0.5–1.5 bar. Bar is the normally used unit for the spray gun pressure in the coatings field (1 bar=$10^5$ Pascal=$10^5$ N/m$^2$).

When a so-called "compliant" application system/spray gun is being used, normal spray gun inlet pressure is approx. 2.0–2.5 bar and reduced spray gun inlet pressure approx. 0.8–1.5 bar. When a high-pressure gun is being used, normal spray gun inlet pressure is approx. 3.5–4.0 bar and reduced spray gun inlet pressure approx. 1.5–2.0 bar. The person skilled in the art knows, depending upon the application system/spray gun type being used, what is meant by normal spray gun inlet pressure and reduced spray gun inlet pressure.

The pigmented coating compositions are generally applied to dry film thicknesses of approximately 15–60 μm.

In step C), application is continued by then preparing mixture 2 of the color- and/or effect-imparting coating composition and diluent V. The two components are here mixed together in a ratio by volume of color- and/or effect-imparting coating composition:diluent V of 1:1 to 1:3, preferably of 1:1.5 to 1:2.5.

In step D), mixture 2 is then applied by spraying at reduced spray gun inlet pressure, optionally after a short flash-off phase, for example of 5–15 minutes at room temperature, onto the spot repair zone and especially into the spot repair zone and the adjacent areas. The person skilled in the art refers to this as misting or a mist coat pass.

The applied coating is then further processed as conventional. Further processing conventionally proceeds after a flash-off phase, for example of 10–20 minutes at room temperature. Flashing-off may, however, also be carried out at slightly elevated temperatures of for example up to 40° C.

If the color- and/or effect-imparting coating layer comprises a color- and/or effect-imparting base coat layer, the following procedure is generally used:

After the optional flash-off phase, a coating layer of a transparent clear coat coating composition is applied onto the base coat layer. The clear coat coating composition may here be applied onto the base coat layer either after drying and/or curing of the base coat layer or wet-on-wet, optionally after a flash-off phase. The clear coat is preferably applied wet-on-wet onto the base coat layer after a flash-off phase.

Suitable clear coats are in principle any known un-pigmented or transparently pigmented coating compositions, as are for example conventional in vehicle refinishing. The clear coats may here be solvent or water-based. In particular, they comprise two-component clear coats based on chemically cross-linking binders, for example based on hydroxyl-functional binder components and polyisocyanate cross-linking agents. Curing of the clear coats may proceed at room temperature over several hours or, after a flash-off phase of for example 10–25 minutes at room temperature, under forced conditions at elevated temperatures, for example of up to 80° C., preferably of 40 to 60° C., for example within 30–80 minutes.

If the color- and/or effect-imparting coating layer comprises a color- and/or effect-imparting one-layer topcoat, curing proceeds, after the optionally provided flash-off phase, as described above for the clear coat.

Suitable substrates are metal and plastics substrates, in particular the substrates known in the automotive industry, such as for example iron, zinc, aluminium, magnesium or alloys thereof, as well as polyurethanes, polycarbonates or polyolefins.

The process according to the invention is particularly advantageously used in the application of solvent-based base coats and clear coats as two-layer structures, in particular in the application of solid-color solvent-based base coats. The advantageous effect of the process according to the invention is particularly marked when applying light-pigmented solid-color base coats.

The following Example is intended to illustrate the invention in greater detail.

EXAMPLE

A metal test sheet provided with a damaged area of approx. 20×20 cm was spot repaired according to the invention. The damaged area (intact primer surfacer coating of an old finish) was sanded and cleaned with silicone remover. A mixture 1 was then produced from a solvent-based, conventional commercial base coat (Standox base coat DB 623, light ivory, Standox GmbH) and a solvent mixture comprising 51 wt. % cyclohexanone and 49 wt. % methoxypropyl acetate in a ratio by volume of 1:1. A mixture 2 was also produced from the solvent-based, conventional commercial base coat (Standox base coat DB 623, Standox GmbH) and the solvent mixture comprising 51 wt. % cyclohexanone and 49 wt. % methoxypropyl acetate in a ratio by volume of 1:2. Mixture 1 was applied onto the pre-treated damaged area in 3 spray passes using a spray gun inlet pressure (MSB high pressure gun from SATA (Farbspritztechnik GmbH&Co.)) of approx. 1.5 bar. After an intermediate flash-off time of 5 minutes at 20° C., mixture 2 was applied at a spray gun inlet pressure of approx. 1.5 bar onto the spot repair zone and into the adjacent areas (misting).

After a final flash-off time of 10 minutes at 20° C., a conventional commercial solvent-based clear coat (Standocryl two component clear coat, Standox GmbH) was applied onto the base coat and, after a flash-off time of 10 minutes at 20° C.; the entire coating was cured for 20 minutes at 60° C.

Comparison Test

By way of comparison, a damaged area prepared as described above was spot repaired as hitherto conventional in the prior art. The following procedure was here used:

A mixture V1 was produced from a solvent-based, conventional commercial base coat (Standox base coat DB 623, light ivory, Standox GmbH) and a conventional base coat diluent (Standox MSB 11050; Standox GmbH; solvent mixture containing butyl acetate and aromatic/aliphatic hydrocarbons) in a ratio by volume of 2:1. Mixture V1 was applied onto the pre-treated damaged area and into the adjacent area in 3 spray passes using a spray gun inlet pressure (spray gun as above) of approx. 1.5 bar. After a final flash-off time of 10 minutes at 20° C., a conventional commercial solvent-based clear coat (Standocryl two-component clear coat, Standox GmbH) was applied onto the base coat and, after a flash-off time of 10 minutes at 20° C., the entire coating was cured for 20 minutes at 60° C.

The base coat applied according to the invention exhibited very smooth flow in the transition or mist zones. No edge marks were visible in the transitional zone between the old finish and the repair finish. Application of the base coat carried out in the comparison test resulted in a yellow/red edge mark in the transitional zone between the old finish and the repair finish.

What is claimed is:

1. A process for refinishing substrates by spot repair, wherein at least one coating layer selected from the group consisting of a color coating layer, a special effect-imparting coating layer and a color coating special effect-imparting layer provided by a coating composition is applied onto a damaged area of a substrate and wherein the process comprises the following steps:

A) preparing a mixture 1 by mixing the coating composition with a diluent V comprising organic solvents in a ratio by volume of coating composition:diluent V of 1.5:1 to 1:1.2, wherein the diluent V comprises:

a) 35–65 wt. % of at least one (cyclo)aliphatic ketone having 3–8 C atoms in the (cyclo)alkyl residue and b) 65–35 wt. % of at least one glycol ether ester having 3–8 C atoms in the glycol ether residue, whereby the sum of weight percentages of a) and b) is 100 wt-%, B) applying the mixture 1 produced in step A) onto the damaged area in a layer thickness such that an opaque coating layer is obtained, C) preparing a mixture 2 by mixing the coating composition with the diluent V in a ratio by volume of coating composition:diluent V of 1:1.5 to 1:2.5, D) applying the mixture 2 produced in step C) on the opaque coating layer obtained step reduced spray gun inlet pressure and E) curing said mixture 1 and mixture 2 applied in Steps B and D.

2. The process according to claim 1, wherein the diluent V comprises:

a) 35–65 wt. % of at least one (cyclo)aliphatic ketone having 5–6 C atoms in the (cyclo)alkyl residue and b) 65–35 wt. % of at least one glycol ether acetate having 4–6 C atoms in the glycol ether residue, whereby the sum of weight percentages of a) and b) is 100 wt-%.

3. The process according to claim 1, wherein the diluent V comprises:

a) 45–55 wt. % of at least one (cyclo)aliphatic ketone having 5–6 C atoms in the (cyclo)alkyl residue and b) 55–45 wt. % of at least one glycol ether acetate having 4–6 C atoms in the glycol ether residue, whereby the sum of weight percentages of a) and b) is 100 wt-%.

4. The process according to claim 1, wherein mixture 1 is produced by mixing the coating composition with the diluent V containing the organic solvents in a ratio by volume of coating composition:diluent V of 1.2:1 to 1:1.1.

5. The process according to claim 1, wherein the coating composition contains color-imparting absorption pigments.

6. The process according to claim 1, wherein the coating composition is a base coat.

7. The process according to claim 1, wherein the coating composition is a one-layer top coat.

8. The process according to claim 6, wherein the coating composition is over coated with a transparent clear coat.

9. The process according to claim 1, wherein the curing in step E) proceeds at a temperature ranging from room temperature to 80° C.

10. The process according to claim 1, wherein the curing in step E) proceeds at a temperature ranging from room temperature to 60° C.

11. The process according to claim 1, wherein the substrate comprises a vehicle body or parts thereof.

* * * * *